US007428488B2

(12) United States Patent
Saito

(10) Patent No.: US 7,428,488 B2
(45) Date of Patent: Sep. 23, 2008

(54) RECEIVED VOICE PROCESSING APPARATUS

(75) Inventor: Mutsumi Saito, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 801 days.

(21) Appl. No.: 10/345,917

(22) Filed: Jan. 16, 2003

(65) Prior Publication Data

US 2004/0019481 A1 Jan. 29, 2004

(30) Foreign Application Priority Data

Jul. 25, 2002 (JP) ..... 2002-216602

(51) Int. Cl.
*G10L 19/00* (2006.01)
*G10L 19/14* (2006.01)
*G10L 21/00* (2006.01)

(52) U.S. Cl. ..... 704/225; 704/200.1; 704/224

(58) Field of Classification Search ..... 704/200.1, 704/224, 225
See application file for complete search history.

(56) References Cited

U.S. PATENT DOCUMENTS 4,609,878 A * 9/1986 Rodgers ..... 330/136
4,630,305 A * 12/1986 Borth et al. ..... 381/94.3
4,658,426 A * 4/1987 Chabries et al. ..... 381/94.3
4,696,878 A * 9/1987 Shimkunas ..... 430/5
4,817,158 A * 3/1989 Picheny ..... 704/224
4,939,685 A * 7/1990 Feintuch ..... 708/322
5,333,200 A * 7/1994 Cooper et al. ..... 381/1
5,479,522 A * 12/1995 Lindemann et al. ..... 381/23.1
5,617,450 A * 4/1997 Kakuishi et al. ..... 708/322
5,680,393 A * 10/1997 Bourmeyster et al. ..... 370/286
5,724,416 A * 3/1998 Foladare et al. ..... 379/202.01
5,937,377 A * 8/1999 Hardiman et al. ..... 704/225
6,104,822 A * 8/2000 Melanson et al. ..... 381/320
6,178,400 B1 * 1/2001 Eslambolchi ..... 704/234
6,314,396 B1 * 11/2001 Monkowski ..... 704/234
2002/0051546 A1 * 5/2002 Bizjak ..... 381/106
2002/0099538 A1 * 7/2002 Saito ..... 704/205
2002/0116187 A1 * 8/2002 Erten ..... 704/233

(Continued)

FOREIGN PATENT DOCUMENTS

JP 03284000 12/1991

(Continued)

OTHER PUBLICATIONS

Sugawara, Tsutomu and Yamada, Hisashi; "A Volume and Frequency Response Control IC for Audio"; Dec. 1980, IEEE Journal of Solid-State Circuits, vol. SC-15, No. 6, pp. 968-971.*

(Continued)

*Primary Examiner*—David R. Hudspeth
*Assistant Examiner*—Justin W Rider
(74) *Attorney, Agent, or Firm*—Katten Muchin Rosenman LLP

(57) ABSTRACT

A received voice processing apparatus is provided, in which the received voice processing apparatus includes: a target spectrum calculation part for calculating, for each frequency band, a target spectrum on the basis of a compression ratio for a voice spectrum; a gain calculation part for calculating a gain value for amplifying the voice spectrum to the target spectrum; a filter coefficient calculation part for calculating a filter coefficient from the gain value; and a filer part for processing a received voice signal by using the filter coefficient.

8 Claims, 15 Drawing Sheets

U.S. PATENT DOCUMENTS

| | | | | |
|---|---|---|---|---|
| 2002/0168000 | A1* | 11/2002 | Nagasawa et al | 375/229 |
| 2004/0190734 | A1* | 9/2004 | Kates | 381/106 |

FOREIGN PATENT DOCUMENTS

| | | |
|---|---|---|
| JP | 6-75595 | 3/1994 |
| JP | 2000-41300 | 2/2000 |
| JP | 2000-349893 | 12/2000 |

OTHER PUBLICATIONS

Usagawa T., Iwata, M., Ebata, M., Speech parameter extraction in noisy environment using a masking model, International Conference on Acoustics, Speech, and Signal Processing, 1994, ICASSP-94, 1994 IEEE, Apr. 19-22, 1994, vol. II, pp. II/81-II/84 vol. 2, Adelaide, SA, Australia.*

Ryoji Suzuki, et al."A Proposal and an Evaluation of the Speech Enhancement Method Based on Compensation of Successive Masking" IEICE Technical Report, Mar. 13, 1992, pp. 31-37, vol. 91., Matsushita Electric Industrial Co., Ltd. Osaka, Japan.

Japanese Office Action with translation dated Oct. 2, 2007 from the corresponding Japanese Patent Application JP 2002-216602.

* cited by examiner

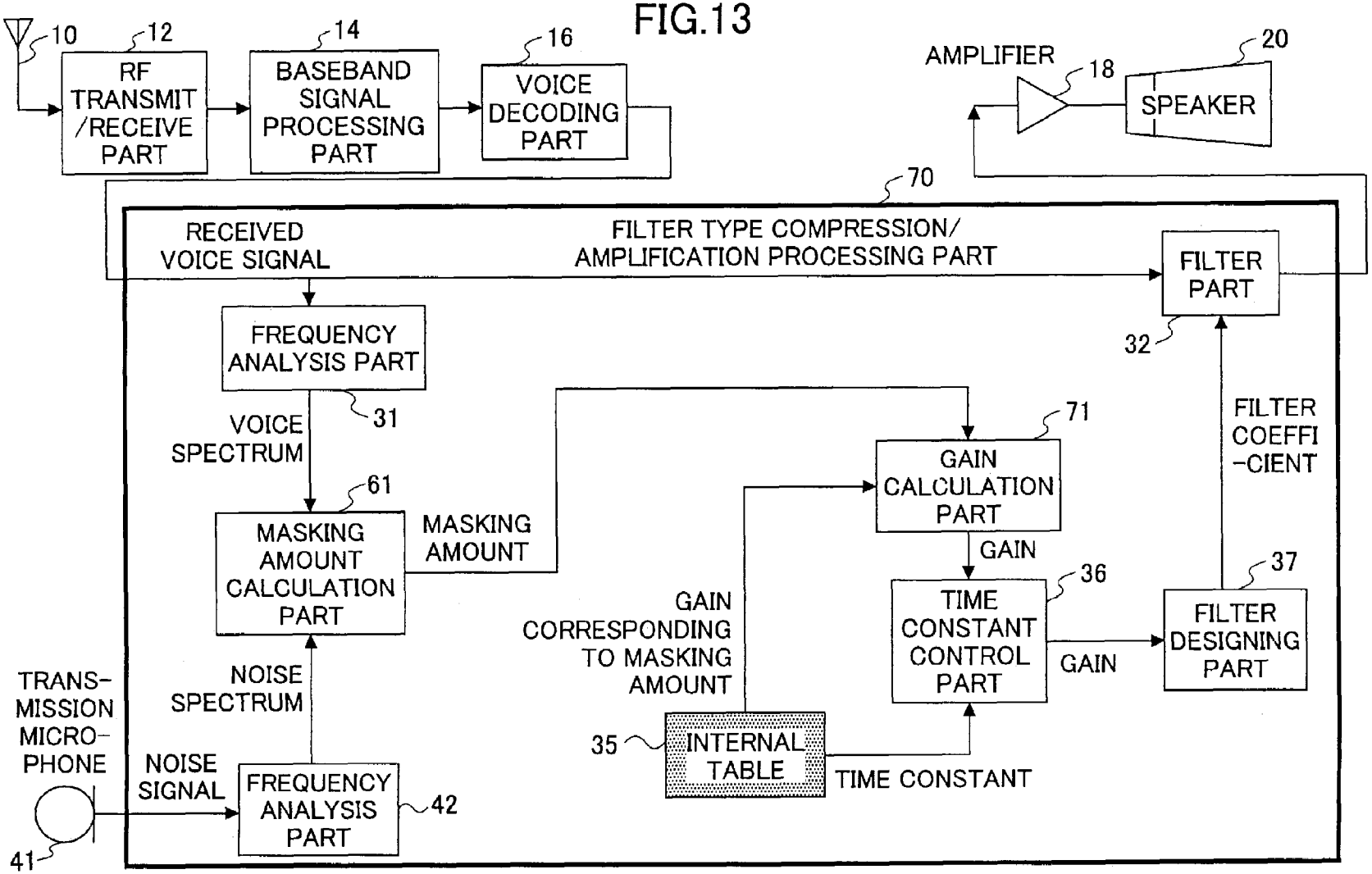
FIG.13
10
12
RF TRANSMIT /RECEIVE PART
14
BASEBAND SIGNAL PROCESSING PART
16
VOICE DECODING PART
AMPLIFIER
18
SPEAKER
20
70
FILTER TYPE COMPRESSION/ AMPLIFICATION PROCESSING PART
RECEIVED VOICE SIGNAL
FILTER PART
32
FILTER COEFFI -CIENT
FILTER DESIGNING PART
37
FREQUENCY ANALYSIS PART
31
VOICE SPECTRUM
MASKING AMOUNT CALCULATION PART
61
MASKING AMOUNT
GAIN CALCULATION PART
71
GAIN
TIME CONSTANT CONTROL PART
36
GAIN
TIME CONSTANT
INTERNAL TABLE
35
GAIN CORRESPONDING TO MASKING AMOUNT
NOISE SPECTRUM
FREQUENCY ANALYSIS PART
42
NOISE SIGNAL
TRANS- MISSION MICRO- PHONE
41

RECEIVED VOICE PROCESSING APPARATUS

BACKGROUND OF THE INVENTION

1. Field of the Invention

The present invention relates to a received voice processing apparatus. More particularly, the present invention relates to a received voice processing apparatus for clarifying received voice in a cellular phone.

2. Description of the Related Art

In recent years, cellular phones become widespread. FIG. 1 is a block diagram of an example of a receiving part of a conventional cellular phone. A signal received by an antenna 10 is tuned by a RF transmit/receive part 12. After that, a baseband signal processing part 14 converts the signal into a baseband signal. Then, a voice decoding part 16 decodes the signal into a receive voice signal, and the amplifier 18 amplifies the signal so that voice is reproduced from a speaker 20.

As the voice decoder 16, a device that efficiently compresses and decompresses a voice signal by using digital signal processing can be used. For example, a decoder of CS-ACELP (Conjugate Structure-Algebraic CELP) can be used. Or, decoder of VSELP (Vector Sum Excited Linear Prediction), ADPCM decoder, PCM decoder and the like can be used.

The cellular phone is often used in the outside. Thus, there are many cases in which received voice can not be heard well when the level of surrounding noise such as traffic noise is high. This phenomenon occurs due to a masking effect by the surrounding noise. That is, low voice can not be heard well and clearness of voice decreases due to the masking effect.

In the voice sending side, a noise canceler is implemented for removing the surrounding noise. However, as for the received voice, any effective measure is not taken. Thus, a user of the cellular phone can not hear well the voice of the party on the other end of the cellular phone under a noisy environment. Conventionally, for hearing the voice well, the user adjusts the volume of the received voice.

Some methods have been contrived for automatically adjusting the received voice according to surrounding noise, in which it is not necessary for the user to change the volume of the received voice. For example, Japanese laid-open patent application No. 9-130453 discloses a method for adjusting the volume of the received voice according to surrounding voice, in which a method on speed of increasing or decreasing the volume of the voice is disclosed.

In a method disclosed in Japanese laid-open patent application No. 8-163227, to prevent that the level of voice is erroneously measured due to voice input from the microphone, a means for discriminating between voice and non-voice is provided, so that accuracy of level measurement is increased. However, only the volume of the received voice adjusted in this method, in which frequency characteristics of voice are not considered.

In Japanese laid-open patent applications No. 5-284200 and No. 8-265075, tone of received voice is changed according to surrounding voice, and, range of voice that is reproduced is adjusted. In addition, in Japanese laid-open patent application No. 2000-349893, masking amount of voice is calculated from surrounding noise, then, a voice emphasizing process is performed.

However, there are following problems for the above-mentioned methods.

As for the Japanese laid-open patent applications No. 9-130453 and No. 8-163227 in which only automatic adjustment of the volume of the received voice is performed, it is predicted that distortion occurs when the voice is largely amplified, which causes user discomfort. In addition, clearness is not improved to a sufficient degree.

As for the Japanese laid-open patent applications No. 5-284200 and No. 8-265075 in which tone is changed and voice range is restricted, since, voice quality is changed, the user may feel something wrong. Thus, clearness is not improved to a sufficient degree.

The Japanese laid-open patent application No. 2000-349893 deals with voice recorded in a recording medium, and does not deal with real time processing. In addition, since the voice emphasizing processing is conventional band division type dynamic range compression processing, there is a problem accompanied by band division. That is, different compression presses is performed on each band of the voice signal, and the compressed voice signal is expanded and synthesized. Thus, the user may feel something wrong due to discontinuity between bands.

SUMMARY OF THE INVENTION

An object of the present invention is to provide a received voice processing apparatus for improving clearness of received voice without largely changing the volume of the voice, in which degradation and change of the voice quality are reduced to a minimum.

The object of the present invention is achieved by a received voice processing apparatus including:

a voice frequency analysis part for calculating a voice spectrum by performing frequency analysis on a received voice signal;

a target spectrum calculation part for calculating, for each frequency band, a target spectrum on the basis of a compression ratio for the voice spectrum;

a gain calculation part for calculating, for each frequency band, a gain value for amplifying the voice spectrum to the target spectrum;

a filter coefficient calculation part for calculating a filter coefficient from the gain value; and a filer part for processing the received voice signal by using the filter coefficient.

According to the above-mentioned invention, the received voice is amplified to a level such that a part of low signal level in the received voice such as a consonant can be heard. Thus, clearness of the received voice can be improved without largely changing the volume of the voice, in which degradation and change of the voice quality are reduced to a minimum.

BRIEF DESCRIPTION OF THE DRAWINGS

Other objects, features and advantages of the present invention will become more apparent from the following detailed description when read in conjunction with the accompanying drawings, in which:

FIG. 13 is a block diagram of a fifth embodiment of the receive voice processing apparatus of the present invention;

DETAILED DESCRIPTION OF THE PREFERRED EMBODIMENTS

Figure 1:
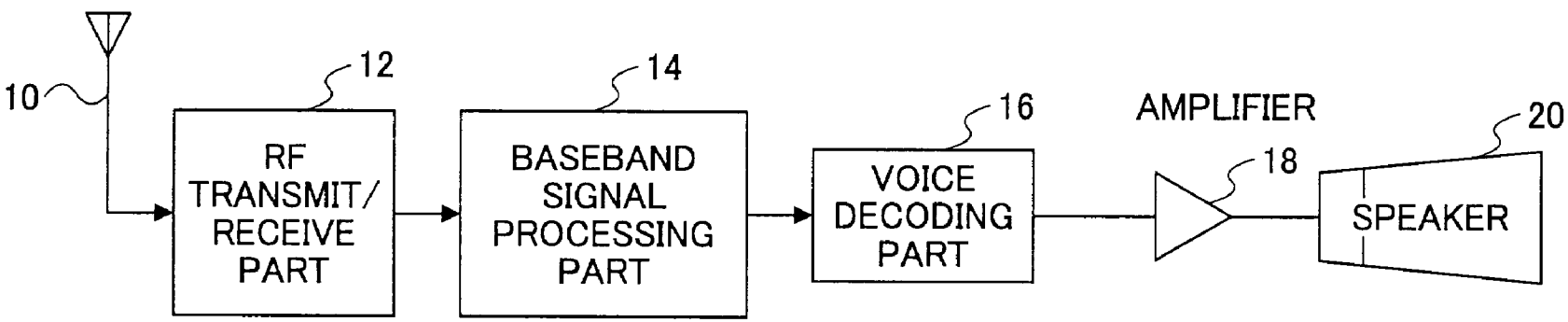
FIG.1 PRIOR ART
FIG. 1 is a block diagram of an example of a receiving part of a conventional cellular phone.
Figure 2:
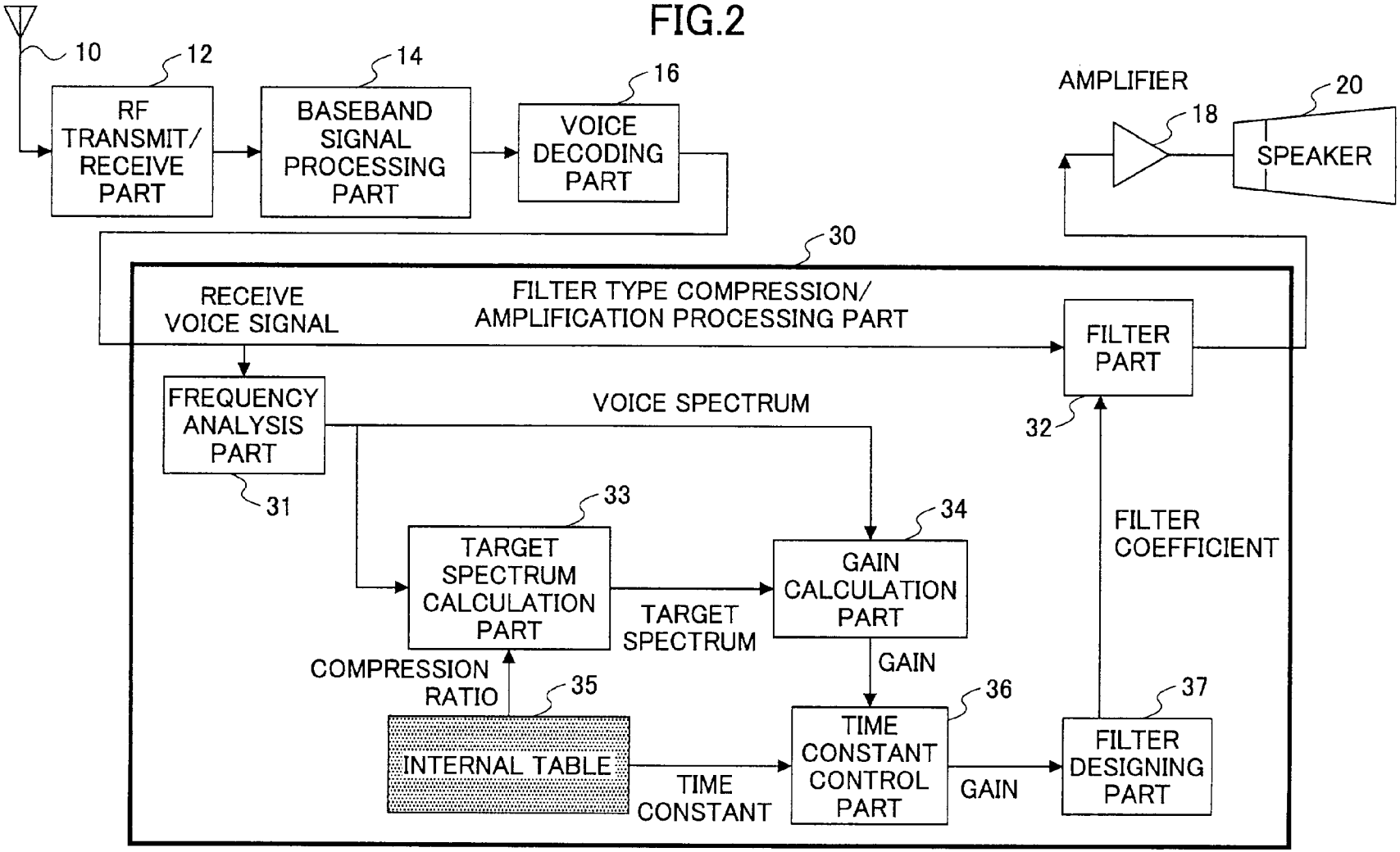
FIG. 2 is a block diagram of a first embodiment of the received voice processing apparatus of the present invention.

FIG. 2 is a block diagram of a first embodiment of the received voice processing apparatus of the present invention. In the figure, same numerals are assigned to the same parts as those of FIG. 1. In this embodiment, compression and amplification ratios are set for each frequency beforehand, so that voice is compressed and amplified by using different ratios for each frequency. It is not necessary to refer to surrounding noise.

In FIG. 2, a received voice signal decoded in the voice decoder 16 is provided to a frequency analysis part 31 and a filter part 32 in a filter type compression/amplification processing part 30.

The frequency analysis part 31 calculates magnitude of each frequency component of the received voice signal (power spectrum). In the following, the power spectrum will be simply referred to as "spectrum". FFT (Fast Fourier Transform) is most appropriate for use as the frequency analysis part 31 from the viewpoint of calculation amount. However, other methods can be used, such as DFT (Discrete Fourier Transformation), filter bank, wavelet transform and the like. The voice spectrum output from the frequency analysis part 31 is provided to a target spectrum calculation part 33 and to a gain calculation part 34.

The target spectrum calculation part 33 calculates a target spectrum by compressing and amplifying the voice spectrum according to a fixed compression ratio supplied from an internal table 35 beforehand, and supplies the target spectrum to the gain calculation part 34.

Under a noisy environment, noise may drown out a low voice in many cases. However, when the voice is amplified according to the present invention, the lower the voice is, the signal is amplified with greater ratio. Thus, the voice that may be drown in the noise can be easily heard. The target spectrum is obtained by performing such compression and amplification for each frequency.

A different compression ratio is set for each frequency band, so that compression and amplification are performed by using different ratio for each frequency band. Generally, the level of the received voice is large in a low frequency, and the level is small in a high frequency. Thus, it is not necessary to much compress the level of the voice signal in the low frequency. On the other hand, it is necessary to largely compress the level in high frequency since the high frequency part of the voice signal may be drown out in the surrounding noise.

Figure 3A:
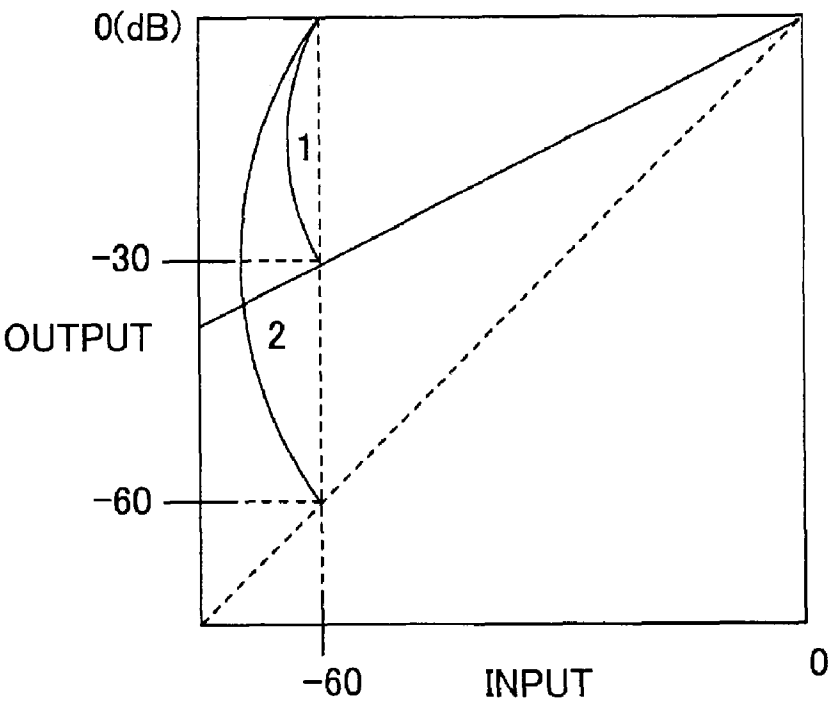
FIG. 3A corresponds to a function for converting an input dynamic range to an output dynamic range.
Figure 3B:
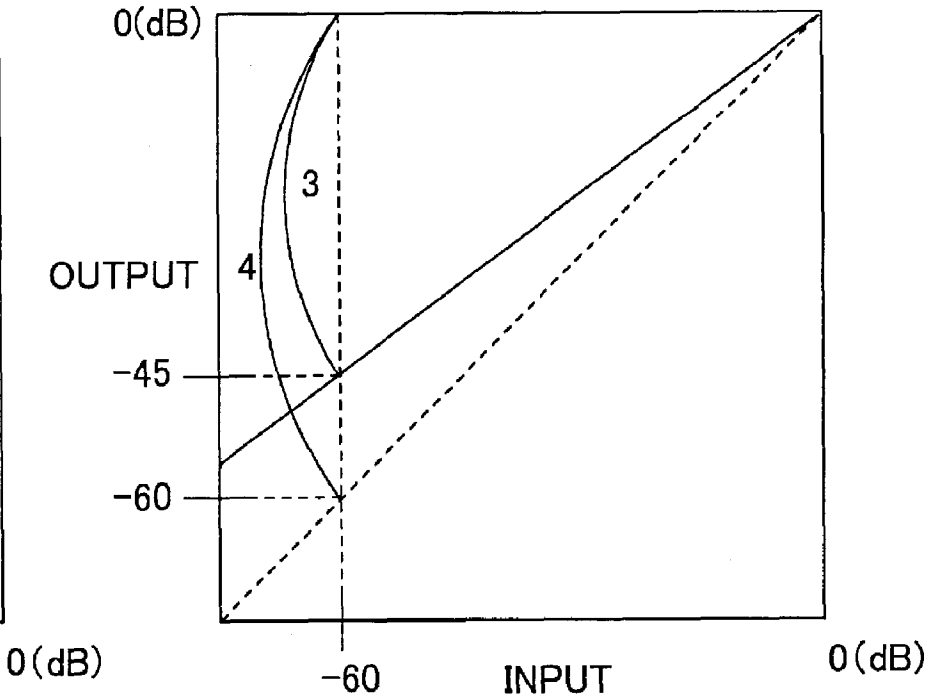
FIG. 3B corresponds to a function for converting an input dynamic range to an output dynamic range.
Figure 4A:
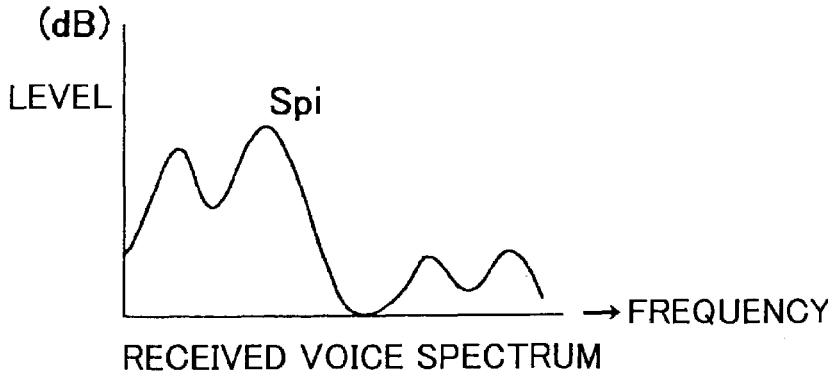
FIGS. 4A-4D show examples of Spi, Spe, Gdb and Glin.
Figure 4B:
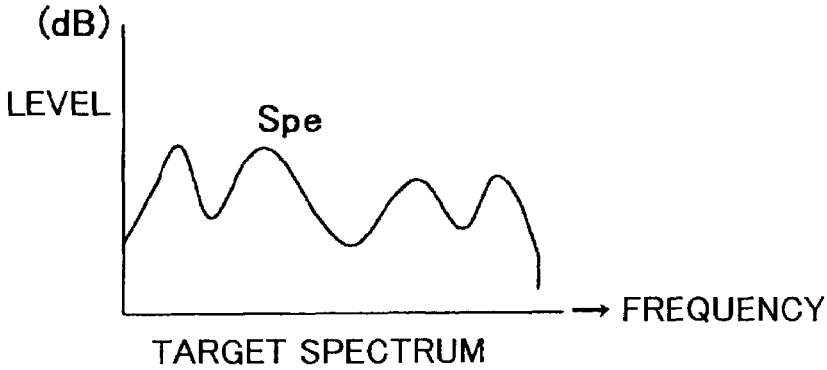
Figure 4C:
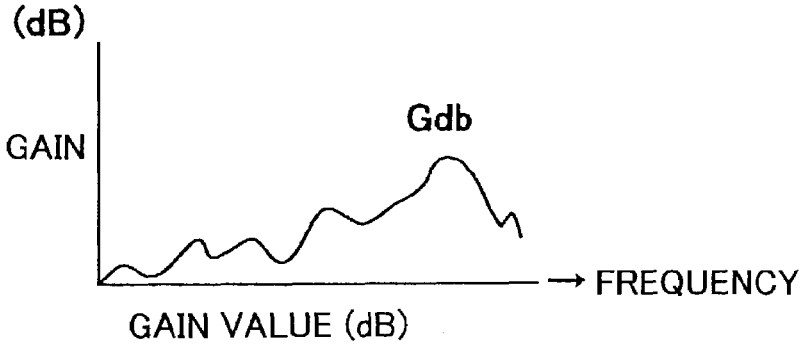
Figure 4D:
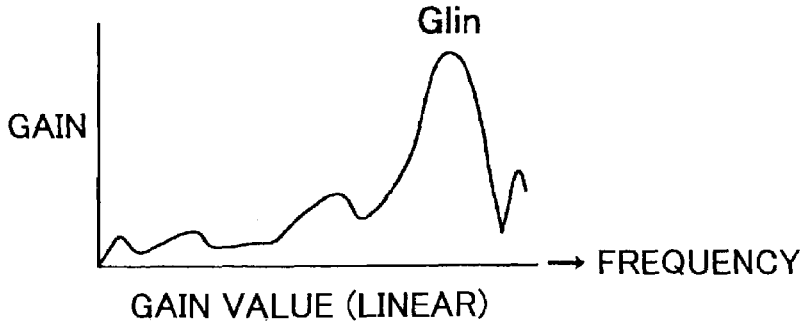

In the target spectrum calculation part 33, the band of the voice is divided into N parts, and a spectrum of the received voice (referred to as Spi(n)) is converted to the target spectrum (referred to as Spe(n)) for each n, wherein n=1~N. For this conversion, a function represented by FIG. 3A or FIG. 3B is used. As the Spi(n), output from the frequency analysis part 31 can be used as it is. In addition, adjacent frequency bands can be processed at one time, so that the division number N can be lessen.

In FIGS. 3A and 3B, the horizontal axis represents the level of an input signal, and the vertical axis represents the level of target output signal, in which the maximum amplitude is 0 dB. Dotted lines represent relationship between the level of the input signal and the level of the output signal when the compression is not performed. Solid lines represent relationship between the level of input signal and the level of the output signal when the compression is performed. The level of the target output signal is uniquely determined according to the level of input signal. FIG. 3A shows a case when the compression ratio C(n)=1/2, wherein the compression ratio is represented by (output dynamic range)/(input dynamic range). FIG. 3B shows a case of C(n)=3/4. The compression range can be any positive number. C(n)>1.0 means expansion, in which, the smaller amplitude becomes further smaller. In reality, the value of C(n) is $1/10 \leqq C(n) < 1.0$. An optimal value of C(n) is determined by an investigation beforehand, and the optimal value is stored in the internal table 35.

The gain calculation part 34 compares the voice spectrum from the frequency analysis part 31 and the target spectrum, and calculates a gain value (difference value between the voice spectrum and the target spectrum) for each frequency band necessary for amplifying the voice spectrum into the target spectrum. Assuming that n=1~N, and assuming that a logarithm of gain is Gdb(n), $$Gdb(n)=Spe(n)-Spi(n).$$

Then, the gain that is represented by logarithm (dB) is converted to a linear value in consideration of designing filter coefficients later. For obtaining linear gain value Glin(n), following equation is used.

$$Glin(n)=pow(10, Gdb(n)/20)$$

In this equation, pow(a, b) means "a" to the power of "b". FIGS. 4A-4D show examples of Spi, Spe, Gdb and Glin.

The time constant control part 36 performs a time constant control process by using a fixed time constant supplied from the internal table 35, so that the gain value from the gain calculation part 34, that is different for each frequency band, changes smoothly with respect to time. That is, by the time constant control process, it can be avoided that the change of the gain value with respect to time becomes steep.

When a gain value at the current time is smaller than a previous gain value, the gain value is decreasing. At this time, the amplitude of the voice is increasing. It means that the voice is rising. Thus, gain adjustment is performed by using the following equation.

$$\text{Gain output}=(\text{gain value at the current time})\times a0+(\text{previous gain value})\times a1$$

When the gain value at the current time is greater than the previous gain value, the gain is increasing. That is, the amplitude of the voice is decreasing. It means that the voice is falling. In this case, following equation is used for gain adjustment.

$$\text{Gain output}=(\text{gain value at the current time})\times b0+(\text{previous gain value})\times b1$$

For example, in order to steeply rise voice, the coefficient a0 is set to be large, and the coefficient a1 is set to small. On the other hand, in order to smoothly rise voice, the coefficient a0 is set to be small, and the coefficient a1 is set to be large, so that the gain value does not change largely from the previous gain value and the change of gain becomes smooth. In the case of falling of voice, the change of gain can be controlled in the same way.

For example, assuming that a rising time is X (sec) and the sampling frequency is sf, the coefficients a0 and a1 are determined by the following equations.

$$a0=\exp(-1.0/(sf\times X+1.0))$$

$$a1=1.0-a0$$

For example, by setting the rising time to be several micro seconds, and setting a falling time to be several tens ~ a hundred micro second, feeling of voice deformation becomes small.

Figure 5A:
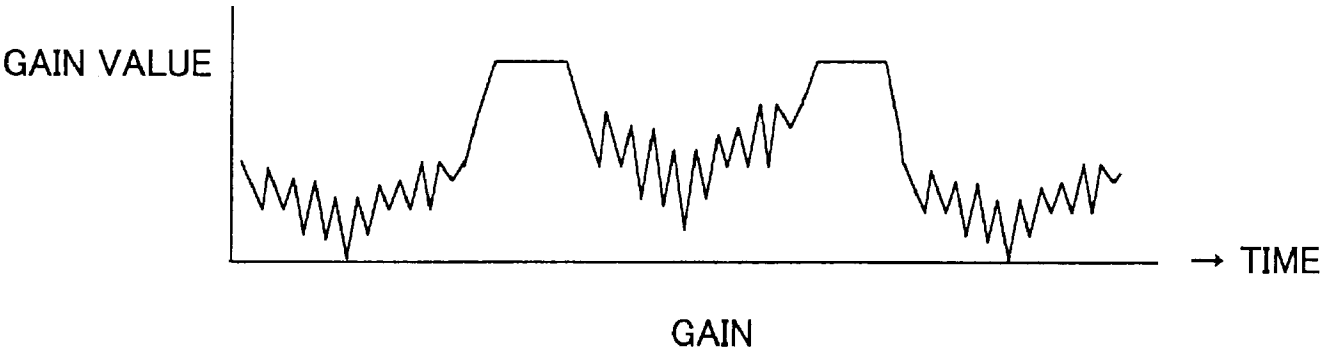
FIGS. 5A and 5B are figures for explaining time constant control.
Figure 5B:
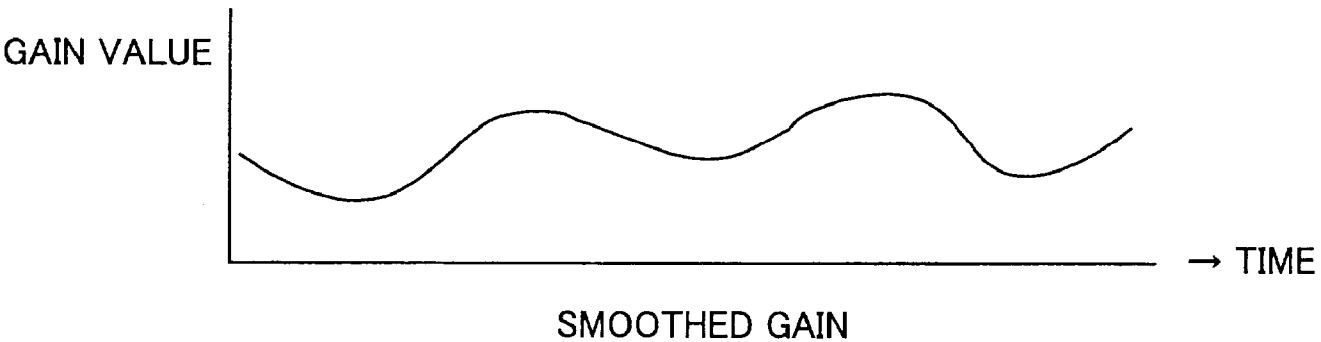

FIGS. 5A and 5B show time constant control. FIG. 5A shows change of gain value before smoothing. This graph shows observation of change of the gain value calculated by the gain calculation part 34 with respect to time for a frequency. FIG. 5B shows change of the gain value after smoothing. It shows that steep changes disappear, and the gain value changes smoothly.

A filter designing part 37 samples the gain values of each frequency band, as sampling data on frequency axis, by using a frequency sampling method such as FFT or DFT, and performs inverse Fourier transform on the sampled data, so that a digital filter having the frequency characteristics is designed. Then, the filter designing part 37 sets filter coefficients on the filter part 32. The filter coefficients change according to time.

Or, after designing an analog filter having predetermined frequency characteristics by using designing algorithm of an analog filter, the filter designing part 37 can convert analog transfer function into digital filter coefficients by using bilinear conversion and the like.

The filter coefficients are set in the filter part 32, so that the filter part 32 performs filtering on the received voice signal supplied from the voice decoder 16. The filter part 32 generally uses the digital filter. The type of the digital filter can be either of FIR (Finite Impulse Response) or IIR (Infinite Impulse Response). Accordingly, the spectrum of the received voice signal is converted into the target spectrum and is output, so that the signal is reproduced and the reproduced voice is output from the speaker 20 via the amplifier 18.

Figure 6A:
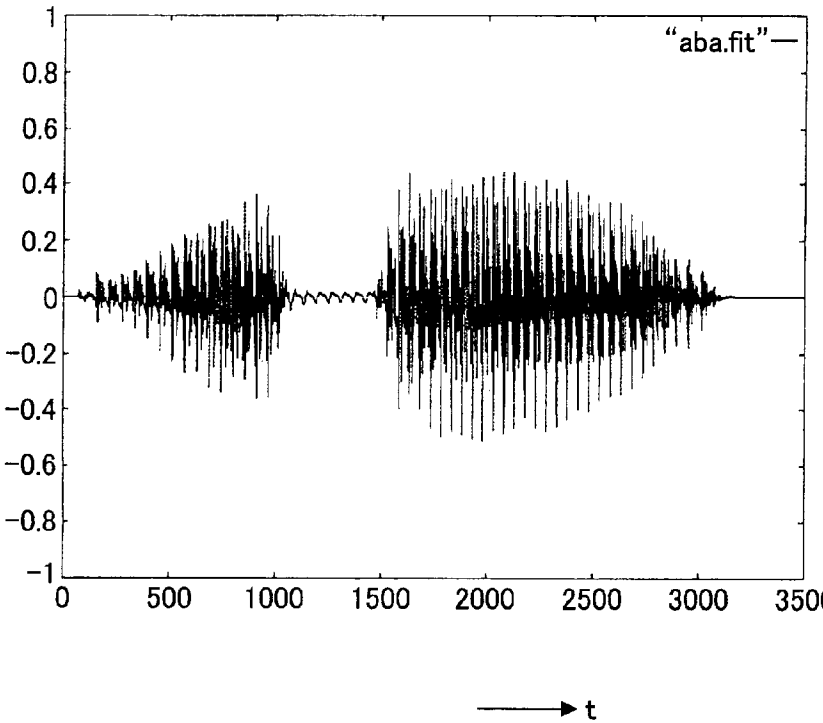
FIG. 6A shows a waveform of the received voice signal that is input to the filter type compression/amplification processing part 30.
Figure 6B:
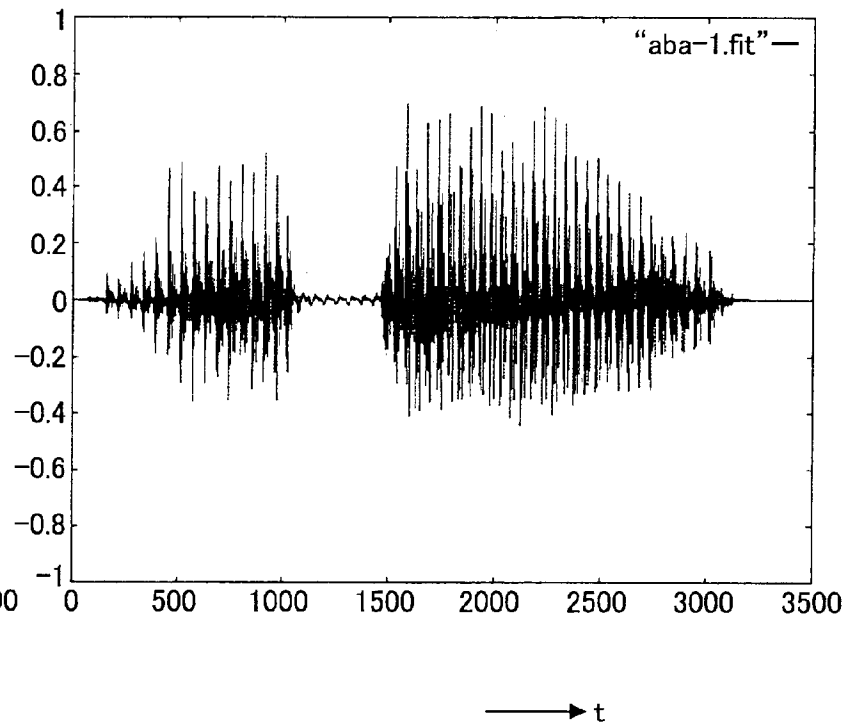
FIG. 6B shows a waveform of the received voice signal that is output from the filter type compression/amplification processing part 30.
Figure 7A:
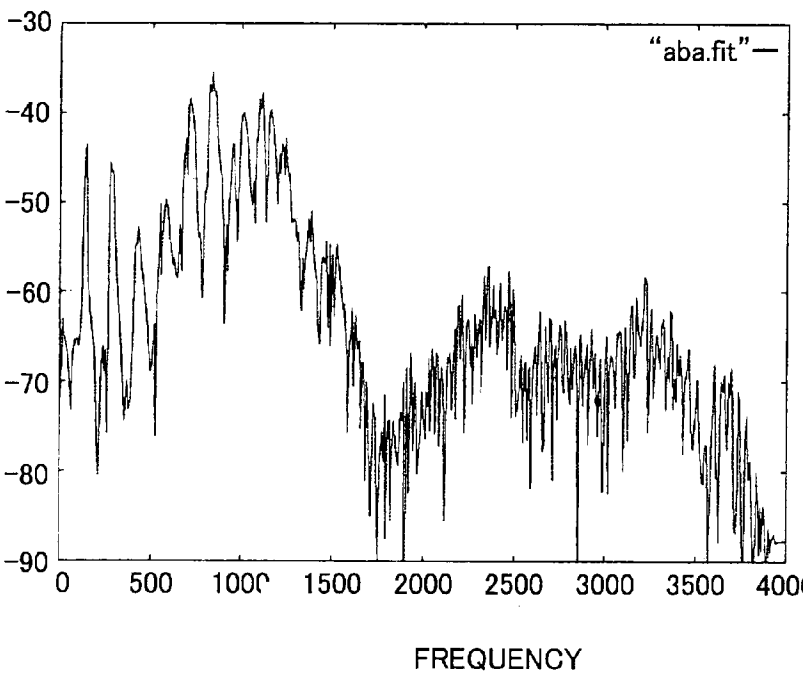
FIG. 7A shows a spectrum of the received voice signal that is input to the filter type compression/amplification processing part 30.
Figure 7B:
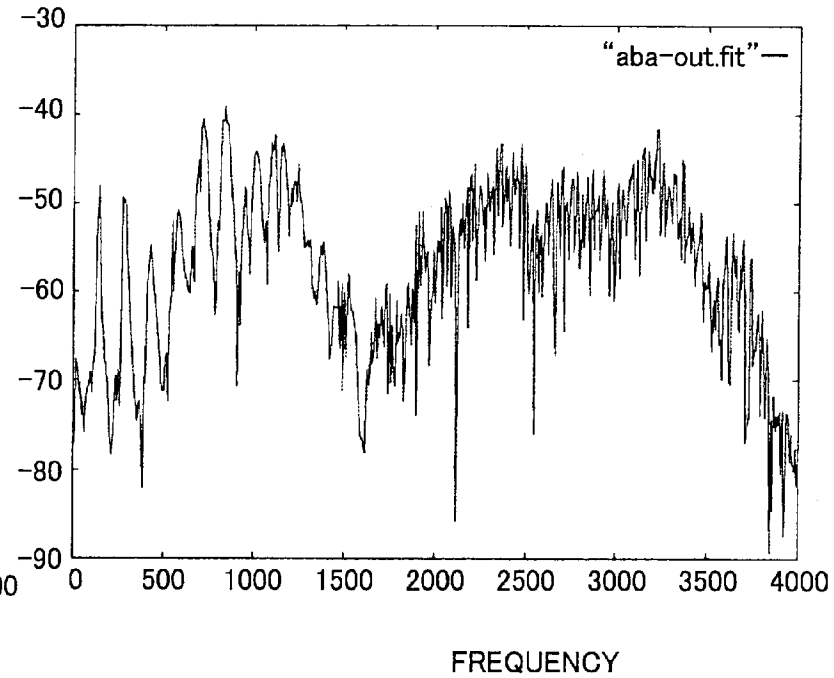
FIG. 7B shows a spectrum of the received voice signal that is output from the filter type compression/amplification processing part 30.

FIG. 6A shows a waveform of the received voice signal that is input to the filter type compression/amplification processing part 30. FIG. 6B shows a waveform of the received voice signal that is output from the filter type compression/amplification processing part 30. These figures show that low amplitude parts in the input side are amplified by the compression and amplification processing. FIG. 7A shows a spectrum of the received voice signal that is input to the filter type compression/amplification processing part 30. FIG. 7B shows the spectrum of the received voice signal that is output from the filter type compression/amplification processing part 30. These figures show that high frequency parts are more emphasized than other parts, in which the high frequency parts are susceptible to surrounding noise.

According to this embodiment, the level of the voice signal is amplified, such that signal of a small level such as a consonant sound can be heard, so that the voice can be heard clearly.

Figure 8:
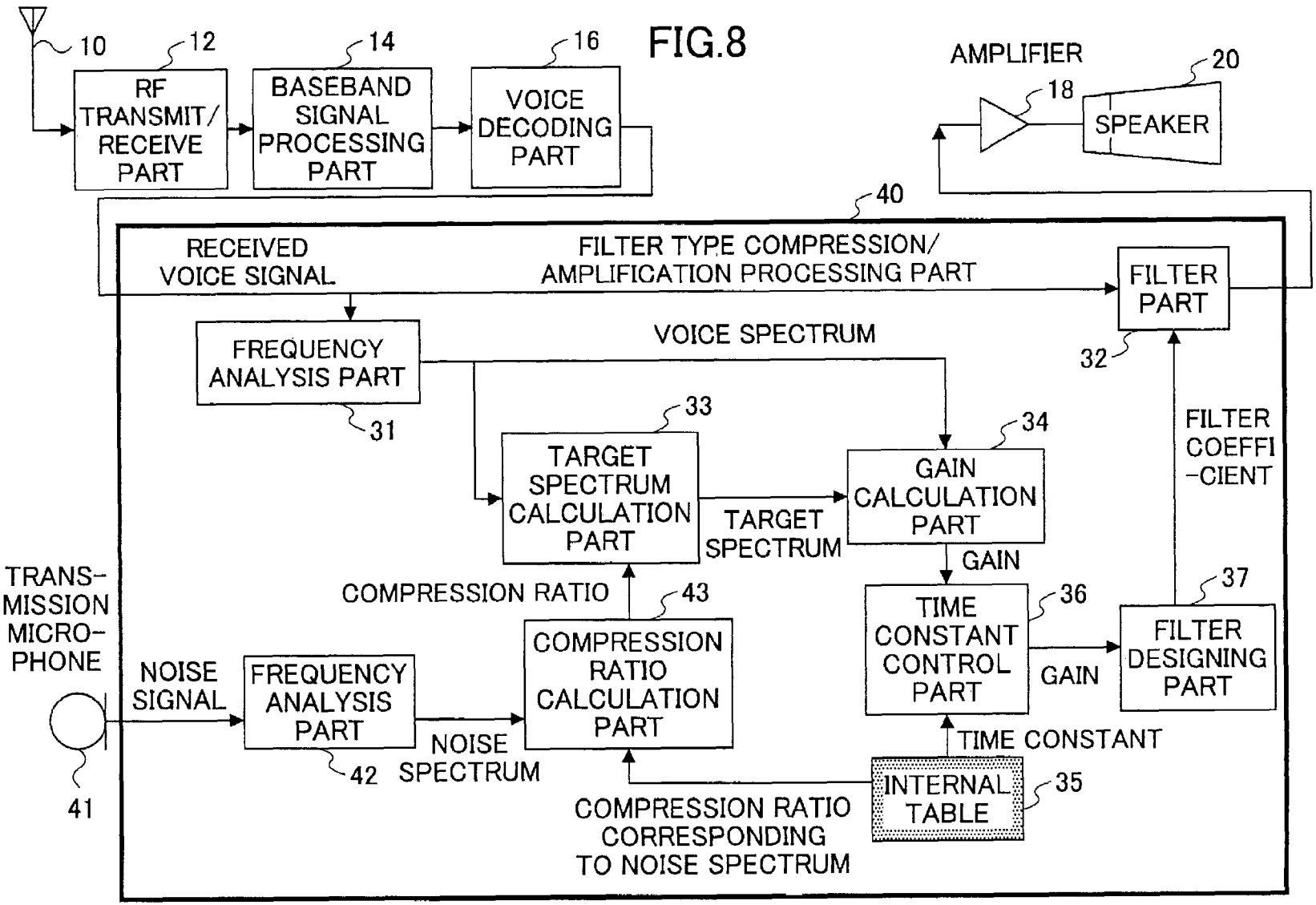
FIG. 8 is a block diagram of a second embodiment of the received voice processing apparatus of the present invention.

FIG. 8 is a block diagram of a second embodiment of the received voice processing apparatus of the present invention. In the figure, same numerals are assigned to the same parts as those of FIG. 2. In this embodiment, compression ratio for each frequency can be adjusted according to frequency characteristics of surrounding noise.

In FIG. 8, a received voice signal decoded in the voice decoder 16 is provided to the frequency analysis part 31 and to the filter part 32 in a filter type compression/amplification processing part 40.

The frequency analysis part 31 calculates voice spectrum that represents each frequency component of the received voice signal. FFT (Fast Fourier Transform) is most appropriate for the frequency analysis part 31 from the viewpoint of calculation amount. However, other methods can be used, such as DFT (Discrete Fourier Transformation), filter bank, wavelet transform and the like. The voice spectrum output from the frequency analysis part 31 is provided to the target spectrum calculation part 33 and to the gain calculation part 34.

A signal input from the transmission microphone 41 is analyzed by a frequency analysis part 42 as surrounding noise, so that a noise spectrum is calculated.

A compression ratio calculation part 43 obtains a compression ratio for each frequency from the noise spectrum. For this purpose, noise spectrum and corresponding compression ratio are predetermined, and compression ratio corresponding to the noise spectrum is read from the internal table 35. Accordingly, by increasing the compression ratio in a frequency band in which the noise level is large, the voice can be amplified to a level at which the voice can be heard, so that clearness can be kept.

Assuming that the noise spectrum is Spn(n), the compression ratio C(n) corresponding to Spn(n) is read from the internal table 35. Also, C(n) can be calculated by using a following equation, $$C(n)=f1(Spn(n))$$

wherein f1 is a function for calculating the compression ratio from the noise spectrum. For example, following equations can be used as f1.

$$\begin{aligned} f1(x) &= 1.0(\text{if}(x < -60\ \text{dB})) \\ &= 1/2(\text{if}(-60\ \text{dB} \leqq x < -40\ \text{dB})) \\ &= 1/4(\text{if}(-40\ \text{dB} \leqq x < -20\ \text{dB})) \\ &= 1/8(\text{if}(-20\ \text{dB} \leqq x)) \end{aligned}$$

The target spectrum calculation part 33 calculates the target spectrum by compressing and amplifying the voice spectrum according to the compression ratio supplied from the compression ratio calculation part 43, and supplies the target spectrum to the gain calculation part 34.

Under a noisy environment, noise may drown out a low voice. However, when the voice is amplified according to the present invention, the voice is amplified such that the smaller the voice is, the greater the ratio of the amplification is. Thus, the voice that may be drown in the noise can be easily heard. The target spectrum is obtained by performing such compression and amplification for each frequency.

A different compression ratio is set for each frequency band, so that compression and amplification are performed by using a different ratio for each frequency band. Generally, the level of the received voice is high in a low frequency, and the level is low in a high frequency. Thus, it is not necessary to largely compress the level of the voice signal in low frequencies. On the other hand, it is necessary to largely compress the level in high frequency since the high frequency part of the voice signal may be drown out in the surrounding noise.

In the target spectrum calculation part 33, the band of the voice is divided into N parts, and received voice spectrum (referred to as Spi(n)) is converted to the target spectrum (referred to as Spe(n)) for each n, wherein N=1~n. For this conversion, a function represented by FIG. 3A or FIG. 3B is used. As the Spi(n), an output from the frequency analysis part 31 can be used as it is. In addition, adjacent frequency bands can be processed at one time, so that the division number N can be lessen.

The gain calculation part 34 compares the voice spectrum from the frequency analysis part 31 with the target spectrum, and calculates a gain value (difference value between the voice spectrum and the target spectrum) for each frequency band necessary for amplifying the voice spectrum into the target spectrum.

The time constant control part 36 performs a time constant control process by using fixed time constants supplied from the internal table 35, so that the gain value from the gain calculation part 34, that is different for each frequency band, changes smoothly with respect to time. That is, by the time constant control process, it can be avoided that the change of the gain value with respect to time becomes steep.

When a gain value at the current time is smaller than a previous gain value, the gain is lowering. At this time, the amplitude of a waveform of the voice is increasing. It means that the voice is rising. Thus, gain adjustment is performed by using the following equation.

$$\text{Gain output}=(\text{gain value at the current time})\times a0+(\text{previous gain value})\times a1$$

When the gain value at the current time is greater than the previous gain value, the gain is increasing. That is, the amplitude of the voice waveform is decreasing. It means that the voice is falling. In this case, a following equation is used for gain adjustment.

$$\text{Gain output}=(\text{gain value at the current time})\times b0+(\text{previous gain value})\times b1$$

For example, assuming that rising time is X (sec) and sampling frequency is sf, the coefficients a0 and a1 are determined by the following equations.

$$a0=\exp(-1.0/(sf\times X+1.0))$$

$$a1=1.0-a0$$

For example, by setting rising time to be several micro seconds, and setting falling time to be several tens ~ a hundred micro second, feeling of voice deformation becomes small.

The filter designing part 37 samples the gain values of each frequency band as sampling data on a frequency axis by using a frequency sampling method such as FFT or DFT, and performs inverse Fourier transform on the sampled data, so that a digital filter having the frequency characteristics is designed. Then, the filter designing part 37 sets filter coefficients on the filter part 32.

The filter coefficients are set in the filter part 32, so that the filter part 32 performs filtering on the received voice signal supplied from the voice decoder 16. Accordingly, the spectrum of the received voice signal is converted into the target spectrum and is output, so that the signal is reproduced and the reproduced voice is output from the speaker 20 via the amplifier 18.

Figure 9:
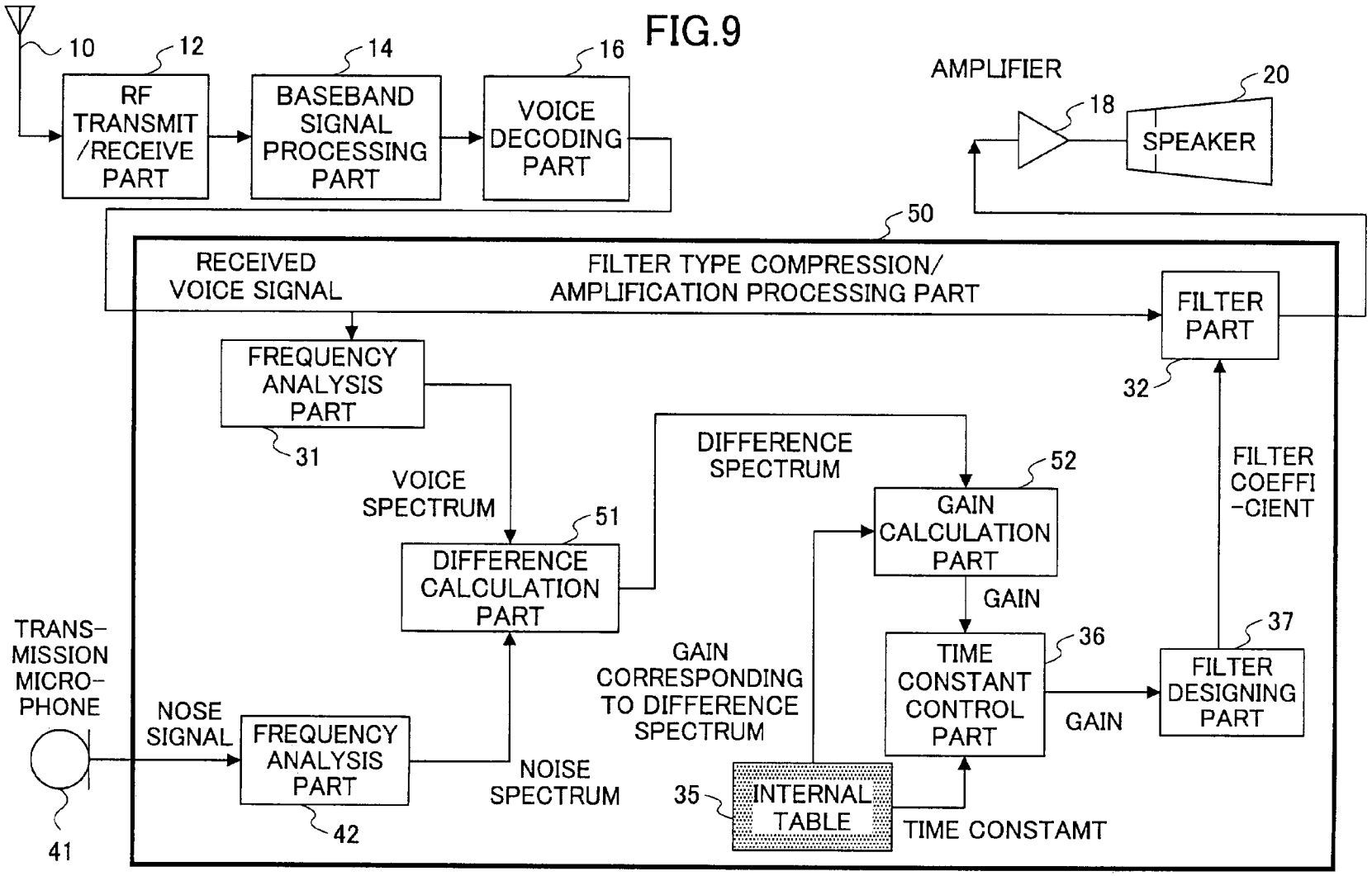
FIG. 9 is a block diagram of a third embodiment of the receive voice processing apparatus of the present invention.

FIG. 9 is a block diagram of a third embodiment of the receive voice processing apparatus of the present invention. In the figure, same numerals are assigned to the same parts as those of FIG. 8. In this embodiment, the compression ratio calculation part 43 in the second embodiment is replaced by a circuit for calculating difference between frequency characteristics of the received voice and frequency characteristics of the surrounding noise.

In FIG. 9, a received voice signal decoded in the voice decoder 16 is provided to the frequency analysis part 31 and to the filter part 32 in a filter type compression/amplification processing part 50.

The frequency analysis part 31 calculates a voice spectrum that represents each frequency component of the received voice signal. FFT (Fast Fourier Transform) is most appropriate for the frequency analysis part 31 from the viewpoint of calculation amount. However, other methods can be used, such as DFT (Discrete Fourier Transformation), filter bank, wavelet transform and the like. The voice spectrum output from the frequency analysis part 31 is provided to a frequency characteristic difference calculation part 51.

A signal input from the transmission microphone 41 is analyzed by the frequency analysis part 42 as the surrounding noise, so that noise spectrum is calculated, and provided to the frequency characteristic difference calculation part 51.

The frequency characteristic difference calculation part 51 calculates the difference between the voice spectrum and the noise spectrum. Assuming that the difference is Spd(n), Spd (n) can be represented by the following equation.

$$Spd(n)=Spi(n)-Spn(n)$$

The gain calculation part 52 calculates gain values for each frequency from the difference Spd(n). The gain value corresponding to Spd(n) may be read from the internal table 35, in addition, it may be calculated. Assuming that logarithm of Spd(n) is Gdb(n), the compression ratio C(n) for each frequency can be calculated by $$C(n)=f2(G\mathrm{db}(n)),$$

wherein f2 is a function for calculating the gain value from the difference between the spectrums. For example, following equations can be used as f2.

$$\begin{aligned} f2(x) &= 1/16(\mathrm{if}(x<-40\ \mathrm{dB})) \\ &= 1/8(\mathrm{if}(-40\ \mathrm{dB}\leqq x<-20\ \mathrm{dB})) \\ &= 1/4(\mathrm{if}(-20\ \mathrm{dB}\leqq x<0\ \mathrm{dB}) \end{aligned}$$

-continued $$= 1/2(\text{if}(0\ \text{dB} \leqq x < +10\ \text{dB})$$

$$= 1.0(\text{if}(+10\ \text{dB} \leqq x)$$

The time constant control part 36 performs a time constant control process by using fixed time constants supplied from the internal table 35, so that the gain value from the gain calculation part 34, that is different for each frequency band, changes smoothly with respect to time. That is, by the time constant control process, it can be avoided that the change of the gain value with respect to time becomes steep.

A filter designing part 37 samples the gain values of each frequency band as sampling data on frequency axis by using a frequency sampling method such as FFT or DFT, and performs inverse Fourier transform on the sampled data, so that a digital filter having the frequency characteristics is designed. Then, the filter designing part 37 sets filter coefficients on the filter part 32.

The filter coefficients are set in the filter part 32, so that the filter part 32 performs filtering on the received voice signal supplied from the voice decoder 16. Accordingly, the spectrum of the received voice signal is converted into the target spectrum and is output, so that the signal is reproduced and the reproduced voice is output from the speaker 20 via the amplifier 18.

According to this embodiment, adaptive processing becomes possible for each frequency, such that, for example, when noise is much larger than the received voice, the gain is further increased. On the other hand, when the received voice is enough larger than the noise, the amplification is not performed.

Figure 10:
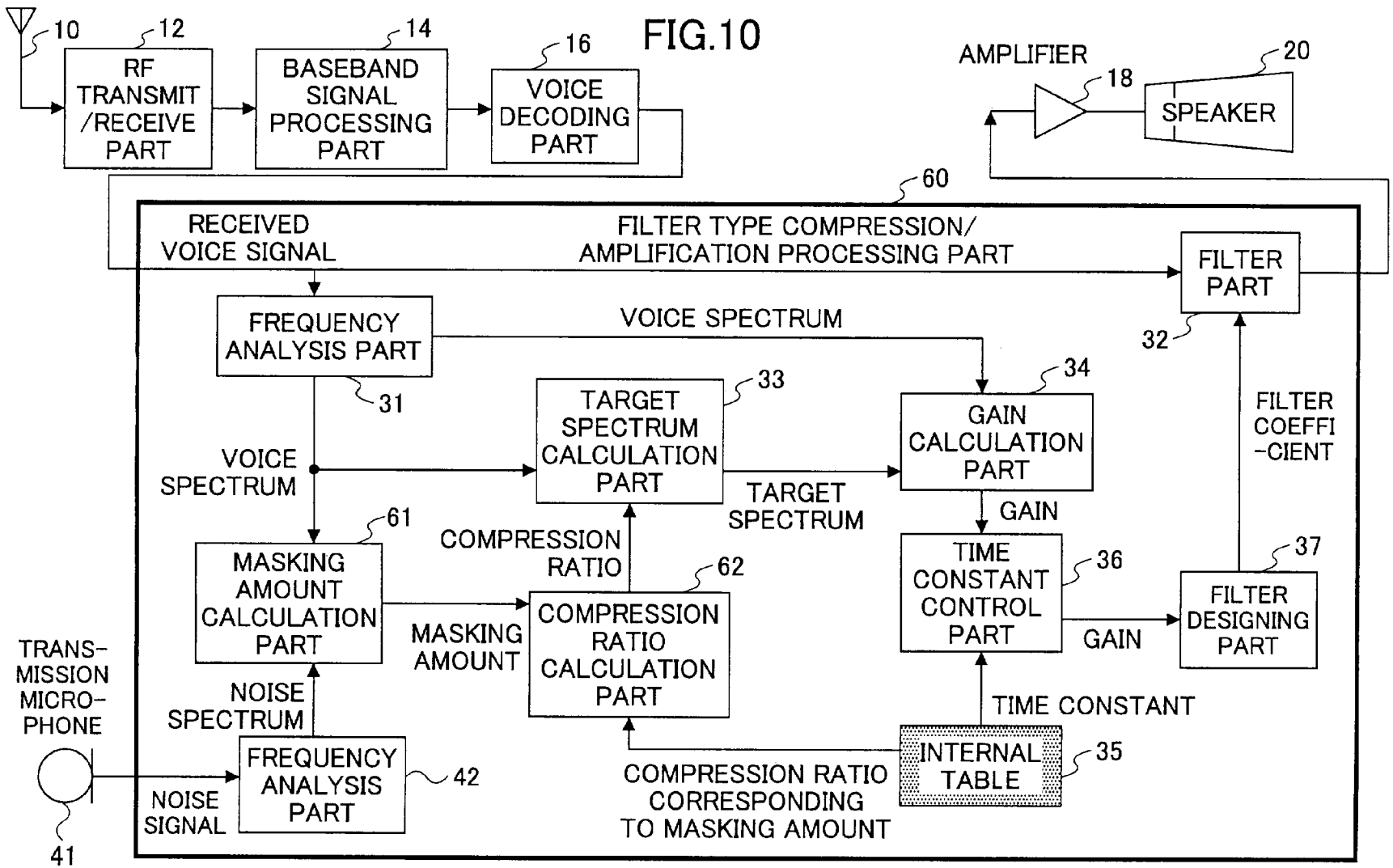
FIG. 10 is a block diagram of a fourth embodiment of the receive voice processing apparatus of the present invention.

FIG. 10 is a block diagram of a fourth embodiment of the receive voice processing apparatus of the present invention. In the figure, same numerals are assigned to the same parts as those of FIG. 8. In this embodiment, the compression ratio is calculated from the frequency characteristics of surrounding noise in consideration of a masking effect of the sense of hearing.

In FIG. 10, a received voice signal decoded in the voice decoder 16 is provided to the frequency analysis part 31 and to the filter part 32 in a filter type compression/amplification processing part 60.

The frequency analysis part 31 calculates a voice spectrum that represents each frequency component of the received voice signal. FFT (Fast Fourier Transform) is most appropriate for the frequency analysis part 31 from the viewpoint of calculation amount. However, other methods can be used, such as DFT (Discrete Fourier Transformation), filter bank, wavelet transform and the like. The voice spectrum output from the frequency analysis part 31 is provided to the target spectrum calculation part 33, the gain calculation part 34 and the masking amount calculation part 61.

A signal input from the transmission microphone 41 is analyzed by the frequency analysis part 42 as the surrounding noise, so that noise spectrum is calculated, and provided to the masking amount calculation part 61.

The masking amount calculation part 61 calculates masking amount for each frequency from the noise spectrum and the voice spectrum. Generally, in the masking, a signal having a large level masks a signal having a small level. Therefore, difference between magnitudes of the noise spectrum and the voice spectrum is calculated first. Then, only when the difference is greater than a predetermined value, masking calculation is performed.

Figure 11:
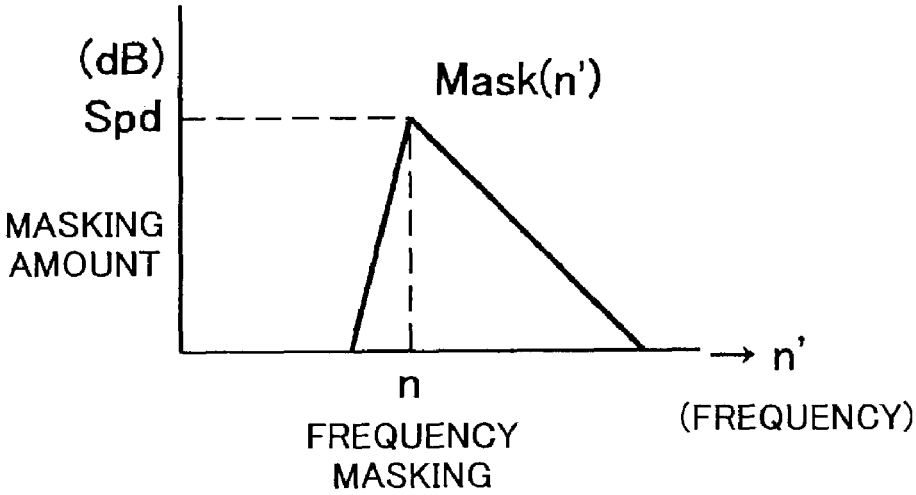
FIG. 11 is a figure for explaining a calculation method of frequency masking.

First, a calculation method of frequency masking will be described by using FIG. 11. The difference Spd(n) between the voice spectrum and the noise spectrum is represented by the following equation.

$$Spd(n)=Spn(n)-Spi(n)$$

Only when Spd(n)>Thref, frequency masking calculation is performed. Thref is a threshold value and is a constant.

It is known that the closer the frequency of the masked signal is to the frequency of the masking signal, the stronger the masking effect is, and the masking effect becomes weak as the frequencies are apart. Thus, by using the following function, masking amount Mask (n) (dB) applied to the received voice by the noise signal is calculated. Assuming that frequency that is masked by the noise signal is n', $$\text{Mask}(n')=Spd(n)-C1\times(n'-n),\ \text{when}\ n'\geqq n,\ \text{and}$$

$$\text{Mask}(n')=Spd(n)-C2\times(n-n'),\ \text{when}\ n'<n,\ \text{wherein}\ C1\ \text{and}\ C2\ \text{are positive constant coefficients.}$$

Figure 12:
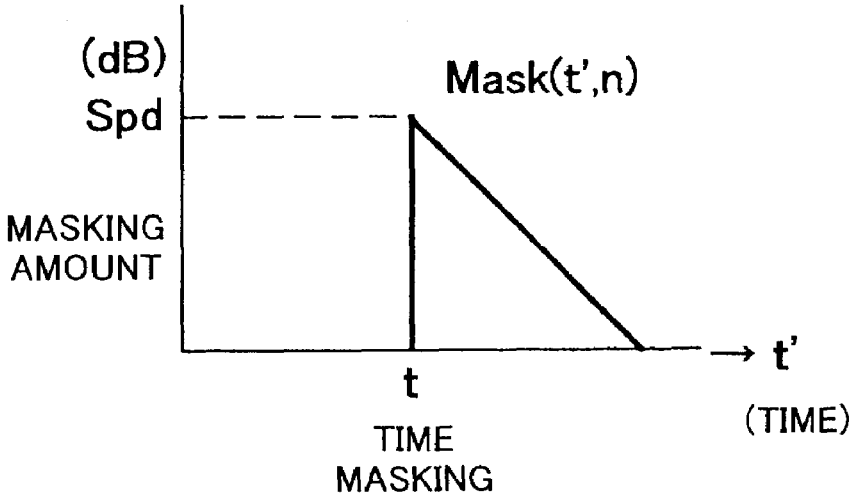
FIG. 12 is a figure for explaining a calculation method of time masking.

Next, masking of time axis is considered. A calculation method of time masking will be described with reference to FIG. 12. It is known that masking is performed between two signals having time difference. Generally, a former signal masks a later signal.

Difference Spd (t, n) between the voice spectrum and the noise spectrum at a frequency band n at a time t is represented by the following equation.

$$Spd(t, n)=Spn(t, n)-Spi(t, n)$$

Then, only when Spd(t, n)>Thret, time masking is calculated. Thret is a threshold and a constant.

Assuming that masking amount in which a signal of time t' is masked by a signal of time t at a frequency n is Mask (t', n), $$\text{Mask}(t', n)=Spd(t, n)-C3\times(t'-t)$$

wherein C3 is a positive constant coefficient and the time t' is a later time than the time t. That is, (t'−t)>0.

The masking amount may be calculated for both of frequency masking and time masking. Also, the masking amount may be calculated either of those.

A compression ratio calculation part 62 obtains compression ratio for each frequency from the masking amount. For this purpose, masking amount and corresponding compression ratio are predetermined, and compression ratio corresponding to the masking amount is read from the internal table 35. Accordingly, by increasing the compression ratio in a frequency band in which masking amount is large, the voice can be amplified to a level at which the voice can be heard, so that clearness can be kept.

The target spectrum calculation part 33 calculates the target spectrum by compressing and amplifying the voice spectrum according to the compression ratio supplied from the compression ratio calculation part 62, and supplies the target spectrum to the gain calculation part 34.

The gain calculation part 34 compares the voice spectrum from the frequency analysis part 31 and the target spectrum, and calculates a gain value (difference value between the voice spectrum and the target spectrum) for each frequency band necessary for amplifying the voice spectrum into the target spectrum.

The time constant control part 36 performs a time constant control process by using fixed time constants supplied from the internal table 35, so that the gain value from the gain calculation part 34, that is different for each frequency band, changes smoothly with respect to time. That is, by the time constant control process, it can be avoided that the change of the gain value with respect to time becomes steep.

A filter designing part 37 samples the gain values of each frequency band as sampling data on frequency axis by using a frequency sampling method such as FFT or DFT, and performs inverse Fourier transform on the sampling data, so that a digital filter having the frequency characteristics is designed. Then, the filter designing part 37 sets filter coefficients on the filter part 32.

The filter coefficients are set in the filter part 32, so that the filter part 32 performs filtering on the received voice signal supplied from the voice decoder 16. Accordingly, the spectrum of the received voice signal is converted into the target spectrum and is output, so that the signal is reproduced and the reproduced voice is output from the speaker 20 via the amplifier 18.

FIG. 13 is a block diagram of a fifth embodiment of the receive voice processing apparatus of the present invention. In the figure, same numerals are assigned to the same parts as those of FIG. 10. In this embodiment, the gain value is directly obtained from the masking amount.

In FIG. 13, a received voice signal decoded in the voice decoder 16 is provided to the frequency analysis part 31 and to the filter part 32 in a filter type compression/amplification processing part 70.

The frequency analysis part 31 calculates the voice spectrum that represents each frequency component of the received voice signal. FFT (Fast Fourier Transform) is most appropriate for the frequency analysis part 31 from the viewpoint of calculation amount. However, other methods can be used, such as DFT (Discrete Fourier Transformation), filter bank, wavelet transform and the like. The voice spectrum output from the frequency analysis part 31 is provided to the target spectrum calculation part 33, the gain calculation part 34 and the masking amount calculation part 61.

A signal input from the transmission microphone 41 is analyzed by the frequency analysis part 42 as the surrounding noise, so that noise spectrum is calculated, and provided to the masking amount calculation part 61.

The masking amount calculation part 61 calculates masking amount for both of the frequency masking and the time masking from the noise spectrum and the voice spectrum. The gain calculation part 71 reads calculated masking amount for each frequency, and reads a gain value corresponding to the masking amount from the internal table 35. In this case, the larger the masking amount is, the larger the gain is.

The time constant control part 36 performs a time constant control process by using fixed time constants supplied from the internal table 35, so that the gain value from the gain calculation part 34, that is different for each frequency band, changes smoothly with respect to time. That is, by the time constant control process, it can be avoided that the change of the gain value with respect to time becomes steep.

A filter designing part 37 samples the gain values of each frequency band as sampling data on frequency axis by using a frequency sampling method such as FFT or DFT, and performs inverse Fourier transform on the sampling data, so that a digital filter having the frequency characteristics is designed. Then, the filter designing part 37 sets filter coefficients on the filter part 32.

The filter coefficients are set in the filter part 32, so that the filter part 32 performs filtering on the received voice signal supplied from the voice decoder 16. Accordingly, the spectrum of the received voice signal is converted into the target spectrum and is output, so that the signal is reproduced and the reproduced voice is output from the speaker 20 via the amplifier 18.

Figure 14:
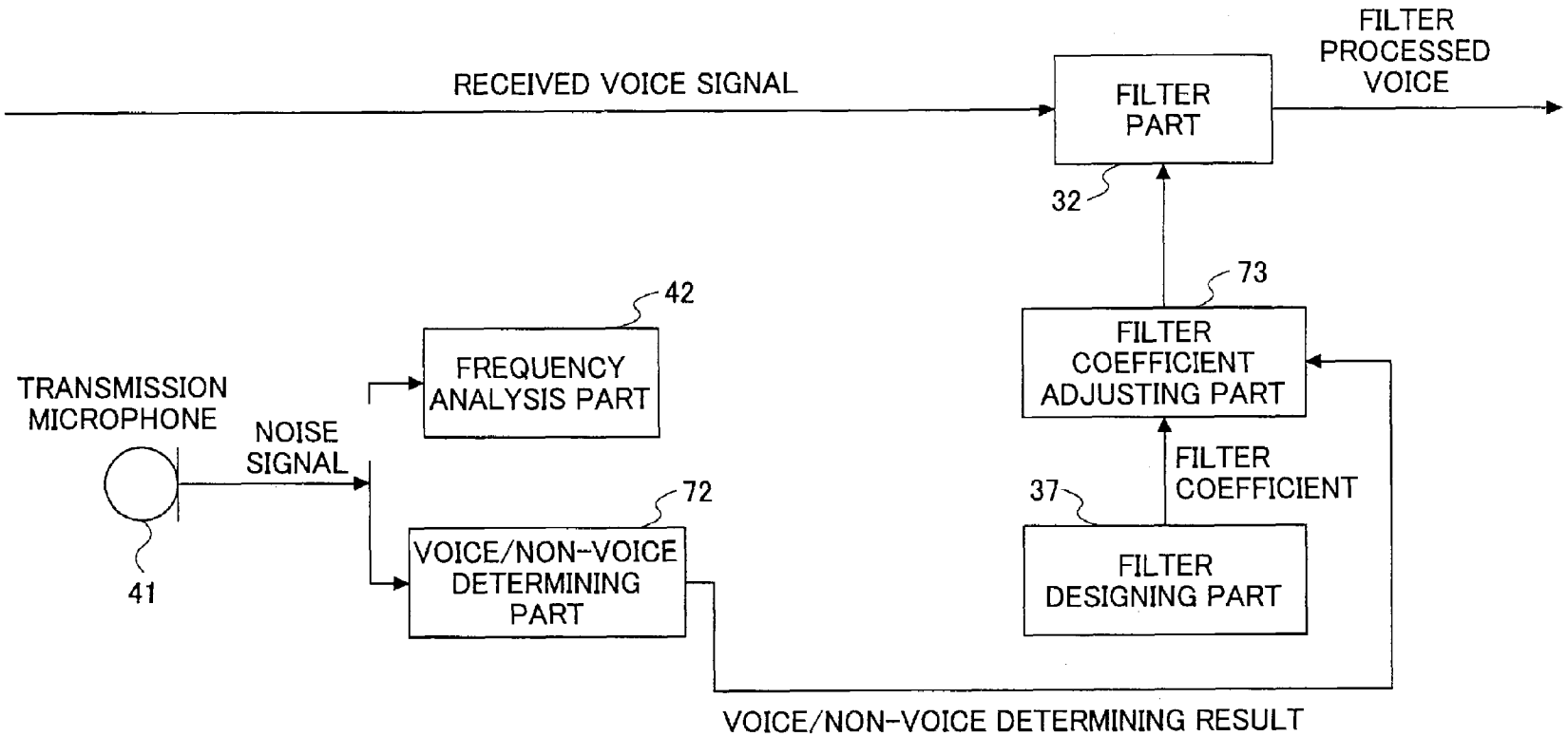
FIG. 14 shows a block diagram of a main part of an embodiment for adjusting degree of compression and amplification according to characteristics of the surrounding noise.

FIG. 14 shows a block diagram of a main part of an embodiment for adjusting degree of compression and amplification according to characteristics of the surrounding noise, in which filter coefficients are adjusted by determining whether the input signal of the transmission microphone is voice or non-voice. In the figure, same numerals are assigned to the same parts as those of FIG. 8.

In FIG. 14, the signal input from the transmission microphone 41 is analyzed as the surrounding noise by the frequency analysis part 42, and is supplied to a voice/non-voice determining part 72. The voice/non-voice determining part 72 determines whether the input of the transmission microphone 41 is voice or not. When it is determined that it is non-voice. Processes shown in FIGS. 8-10 and 13 are performed.

When the voice/non-voice determining part 72 determines that the input is voice, there is a high possibility that the voice is the user's voice. Thus, if the input of the transmission microphone 41 is determined to be surrounding noise, the received voice is extremely amplified. Thus, to avoid this phenomenon, a filter coefficient adjusting part 73 performs following processes.

(1) The filter coefficient adjusting part 73 replaces the filter coefficients supplied from the filter designing part 37 with an initial value (for example, a value by which amplification is not performed), and sets the initial value in the filter part 32.

(2) The filter coefficient adjusting part 73 determines the maximum value of a filter coefficient. When a filter coefficient supplied from the filter designing part 37 exceeds the maximum value, the filter coefficient is replaced by the maximum value and the maximum value is set in the filter part 32.

(3) The filter coefficient adjusting part 73 stops updating the filter coefficients of the filter part 32. That is, the filter coefficients just before the non-voice state is changed to the voice state are kept.

In each configuration shown in FIGS. 8-10 and 13, there is the possibility that the voice of the user is determined to be large surrounding noise, so that received voice is extremely amplified and the sound may annoy the user. On the other hand, according to the configuration of FIG. 14, it can be avoided that the voice is extremely amplified while the user is speaking.

Figure 15:
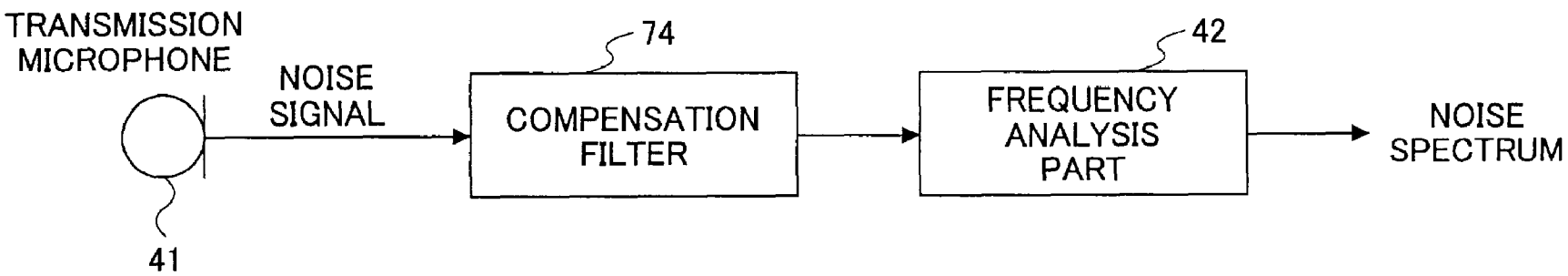
FIG. 15 shows a block diagram of an embodiment for compensating for a diffraction effect due to the head of the user for the noise signal.

FIG. 15 shows a block diagram of an embodiment for compensating for a diffraction effect due to the head of the user for the noise signal. In the figure, the output signal of the transmission microphone 41 is supplied to the frequency analysis part 42 via a compensation filter 74, in which the compensation filter 74 is for compensating for the diffraction effect of the head. The compensation filter 74 is for compensating for difference, due to diffraction effect of the head of the user, between the input of the transmission microphone 41 and the surrounding noise that is actually input to the ear of the user. The filter coefficient is calculated beforehand. Accordingly, frequency characteristics of noise that is actually heard from the ear can be estimated, so that the process becomes in touch with reality, and clear received voice can be obtained.

Figure 16:
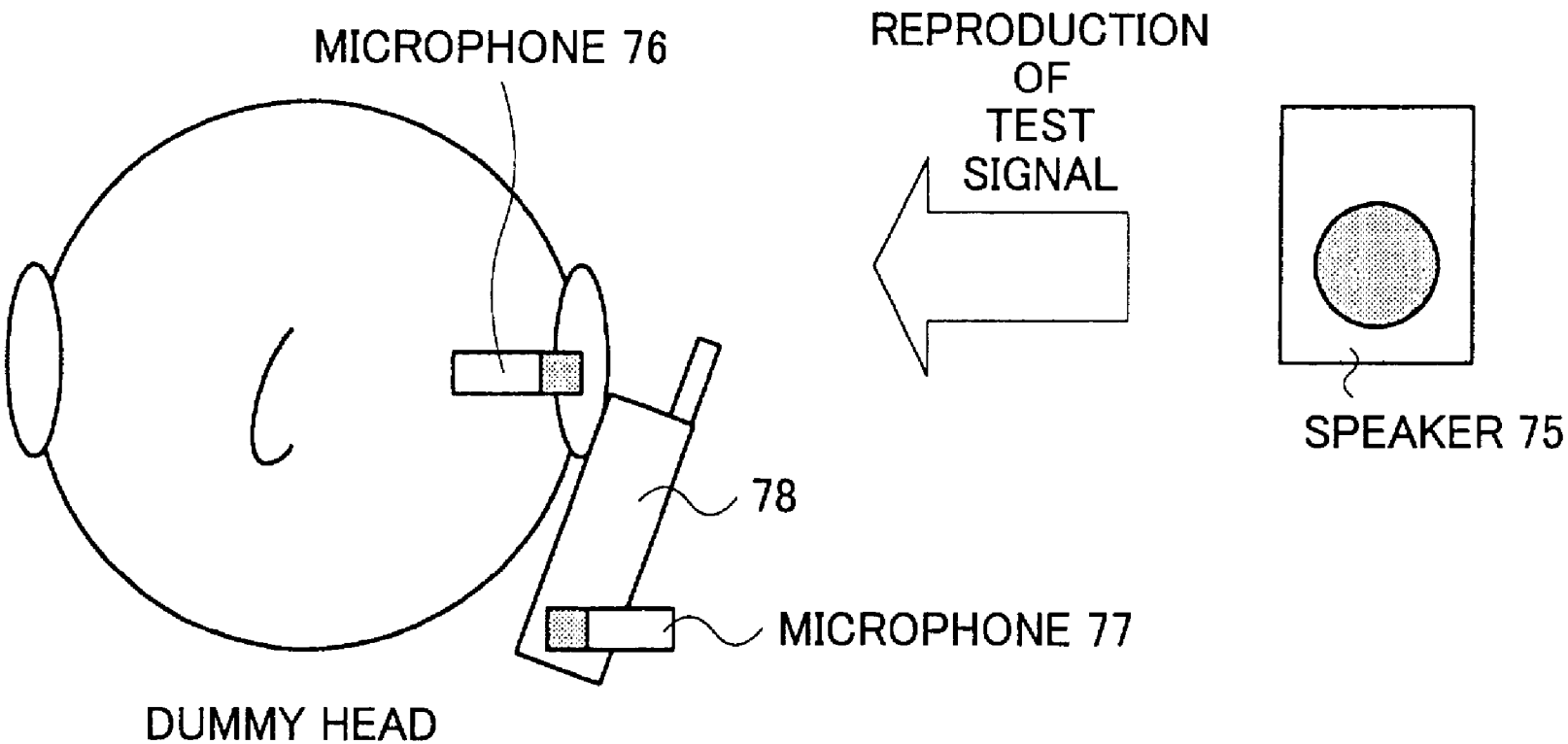
FIG. 16 shows a method for obtaining the filter coefficient of the compensation filter 74.

FIG. 16 shows a method for obtaining the filter coefficient of the compensation filter 74. As shown in FIG. 16, a test signal is reproduced from the speaker 75, and the test signal is collected by microphones 76 and 77. The microphone 76 is set close to the user's ear, and the microphone 77 is set at a position of the microphone of the cellular phone 78. Difference between frequency characteristics obtained by the microphone 76 and frequency characteristics obtained by the microphone 77 is measured, and the filter coefficient for compensating the difference is calculated beforehand. Or, impulse responses at the microphones 76 and 77 are measured, and the filter may be designed from the difference of the impulse responses.

As mentioned above, according to the present invention, a received voice processing apparatus is provided. The received voice processing apparatus includes: a voice frequency analysis part for calculating a voice spectrum by performing frequency analysis on a received voice signal; a target spectrum calculation part for calculating, for each frequency band, a target spectrum on the basis of a compression ratio for the voice spectrum; a gain calculation part for calculating, for each frequency band, a gain value for amplifying the voice spectrum to the target spectrum; a filter coefficient calculation part for calculating a filter coefficient from the gain value; and a filer part for processing the received voice signal by using the filter coefficient.

According to the above-mentioned invention, the received voice is amplified to a level such that a part of low signal level in the received voice such as a consonant can be heard. Thus, clearness of the received voice can be improved without largely changing the volume of the voice, in which degradation and change of the voice quality are reduced to a minimum.

The received voice processing apparatus may further includes: a surrounding noise frequency analysis part for calculating a noise spectrum by performing frequency analysis on an input signal from a transmission microphone; and a compression ratio calculation part for calculating the compression ratio for each frequency band according to the noise spectrum.

Accordingly, the compression ratio can be increased in a frequency band having a high level noise. Thus, clearness of the received voice can be improved without largely changing the volume of the voice, in which degradation and change of the voice quality are reduced to a minimum.

The received voice processing apparatus may includes: a voice frequency analysis part for calculating a voice spectrum by performing frequency analysis on a received voice signal; a surrounding noise frequency analysis part for calculating a noise spectrum by performing frequency analysis on an input signal from a transmission microphone; a gain calculation part for calculating, for each frequency band, a gain value for amplifying the voice spectrum according to a difference between the voice spectrum and the noise spectrum; a filter coefficient calculation part for calculating a filter coefficient from the gain value; and a filer part for processing the received voice signal by using the filter coefficient.

Accordingly, adaptive processing becomes possible, such that, for example, when noise is much larger than the received voice, the gain is further increased. On the other hand, when the received voice is enough larger than the noise, the amplification is not performed.

Also, the received voice processing apparatus may include: a voice frequency analysis part for calculating a voice spectrum by performing frequency analysis on a received voice signal; a surrounding noise frequency analysis part for calculating a noise spectrum by performing frequency analysis on an input signal from a transmission microphone; a masking amount calculation part for calculating masking amount by using the noise spectrum and the voice spectrum; a gain calculation part for calculating, for each frequency band, a gain value for amplifying the voice spectrum according to the masking amount; a filter coefficient calculation part for calculating a filter coefficient from the gain value; and a filer part for processing the received voice signal by using the filter coefficient.

The received voice processing apparatus may further includes: a compression ratio calculation part for calculating a compression ratio for each frequency band according to the masking amount; a target spectrum calculation part for calculating, for each frequency band, a target spectrum on the basis of the compression ratio; wherein the gain calculation part calculates the gain value by using the voice spectrum and the target spectrum instead of the masking amount.

Accordingly, the compression ratio can be increased in a frequency band having large masking amount, so that the voice can be properly amplified.

The received voice processing apparatus may further include: a time constant control part for performing time constant control on the gain value, and supplying the gain value on which the time constant control is performed to the filter coefficient calculation part.

Accordingly, it can be avoided that the change of the gain value with respect to time becomes steep, so that the gain value change smoothly.

The received voice processing apparatus may includes: a voice/non-voice determining part for determining whether an input signal from a transmission microphone is voice of the user of the received voice processing apparatus or not; and a filter coefficient adjusting part for supplying the filter coefficient to the filter part when the input signal is not the voice of the user.

Accordingly, the voice is not extremely amplified while the user is speaking.

The received voice processing apparatus may includes: a compensation filter for compensating for a diffraction effect due to the head of the user of the received voice processing apparatus for the input signal, and supplying the input signal to the surrounding noise frequency analysis part.

Accordingly, frequency characteristics of noise that is actually heard from the ear can be estimated, so that the process becomes in touch with reality, and clear received voice can be obtained.

The present invention is not limited to the specifically disclosed embodiments, and variations and modifications may be made without departing from the scope of the present invention.

What is claimed is:

1. A received voice processing apparatus comprising:

a voice frequency analysis part for calculating a voice spectrum by performing frequency analysis on a received voice signal;

a target spectrum calculation part for calculating, for each frequency band, a target spectrum on the basis of a compression ratio for said voice spectrum;

a gain calculation part for calculating, for each frequency band, a gain value for amplifying said voice spectrum to said target spectrum;

a filter coefficient calculation part for calculating a filter coefficient from said gain value;

a filter part for processing said received voice signal by using said filter coefficient;

a surrounding noise frequency analysis part for calculating a noise spectrum by performing frequency analysis on an input signal from a transmission microphone; and a compression ratio calculation part for calculating said compression ratio for each frequency band according to said noise spectrum.

2. The received voice processing apparatus as claimed in claim 1, said received voice processing apparatus further comprising:

a time constant control part for performing time constant control said gain value, and supplying said gain value on which said time constant control is performed to said filter coefficient calculation part.

3. The received voice processing apparatus as claimed in claim 1, said received voice processing apparatus further comprising:

a voice/non-voice determining part for determining whether an input signal from a transmission microphone is voice of the user of the received voice processing apparatus or not; and a filter coefficient adjusting part for supplying said filter coefficient to said filter part when said input signal is not the voice of the user.

4. The received voice processing apparatus as claimed in claim 1, said received voice processing apparatus further comprising:

a compensation filter for compensating for a diffraction effect due to the head of the user of the received voice processing apparatus for said input signal, and supplying said input signal to said surrounding noise frequency analysis part.

5. A received voice processing apparatus comprising:

a voice frequency analysis part for calculating a voice spectrum by performing frequency analysis on a received voice signal;

a surrounding noise frequency analysis part for calculating a noise spectrum by performing frequency analysis on an input signal from a transmission microphone;

a masking amount calculation part for calculating a masking amount applied to said received voice signal by said input signal by using said noise spectrum and said voice spectrum;

a gain calculation part for calculating, for each frequency band, a gain value for amplifying said voice spectrum to perform level compression according to said masking amount;

a filter coefficient calculation part for calculating a filter coefficient from said gain value;

a filter part for processing said received voice signal by using said filter coefficient;

a compression ratio calculation part for calculating a compression ratio for each frequency band according to said masking amount; and a target spectrum calculation part for calculating, for each frequency band, a target spectrum on the basis of said compression ratio, wherein said gain calculation part calculates said gain value by using said voice spectrum and said target spectrum instead of said masking amount.

6. The received voice processing apparatus as claimed in claim 5, said received voice processing apparatus further comprising:

a time constant control part for performing time constant control on said gain value, and supplying said gain value on which said time constant control is performed to said filter coefficient calculation part.

7. The received voice processing apparatus as claimed in claim 5, said received voice processing apparatus further comprising:

a voice/non-voice determining part for determining whether an input signal from a transmission microphone is voice of the user of the received voice processing apparatus or not;

a filter coefficient adjusting part for supplying said filter coefficient to said filter part when said input signal is not the voice of said user.

8. The received voice processing apparatus as claimed in claim 5, said received voice processing apparatus further comprising:

a compensation filter for compensating for a diffraction effect due to the head of the user of the received voice processing apparatus for said input signal, and supplying said input signal to said surrounding noise frequency analysis part.

* * * * *